United States Patent [19]

Ulrich et al.

[11] Patent Number: 4,959,170

[45] Date of Patent: Sep. 25, 1990

[54] RINSING COMPOSITION FREE FROM PHOSPHATE

[75] Inventors: Hannsjörg Ulrich, Erftstadt; Lothar Westermann, Cologne, both of Fed. Rep. of Germany

[73] Assignee: Hoechst AG, Frankfurt am Main, Fed. Rep. of Germany

[21] Appl. No.: 274,691

[22] Filed: Nov. 21, 1988

Related U.S. Application Data

[63] Continuation of Ser. No. 80,961, Aug. 3, 1987, abandoned.

[30] Foreign Application Priority Data

Aug. 16, 1986 [DE] Fed. Rep. of Germany ..... 3627773

[51] Int. Cl.[5] ..... C11D 3/12; C11D 7/20

[52] U.S. Cl. ..... 252/135; 252/139; 252/141; 252/531

[58] Field of Search ..... 252/135, 139, 141, 531

[56] References Cited

U.S. PATENT DOCUMENTS

| | | | |
|---|---|---|---|
| 3,941,710 | 3/1976 | Gilbert et al. | 252/99 |
| 4,031,022 | 6/1977 | Vogt et al. | 252/89 R |
| 4,237,024 | 12/1980 | Fedechko | 252/99 |
| 4,608,188 | 8/1986 | Parker et al. | 252/99 |
| 4,664,839 | 5/1987 | Reick | 252/175 |
| 4,728,443 | 3/1988 | Reick et al. | 252/135 |

FOREIGN PATENT DOCUMENTS

| | | |
|---|---|---|
| 0217732 | 4/1987 | European Pat. Off. . |
| 2435479 | 2/1976 | Fed. Rep. of Germany . |

*Primary Examiner*—William R. Dixon, Jr.
*Assistant Examiner*—Helene Klemanski

[57] ABSTRACT

A rinsing composition free from phosphate contains as a builder a crystalline layer sodium silicate of the general formula $NaMSi_xO_{2x+1}.y\ H_2O$, in which M is sodium or hydrogen, x is a number of 1.9–4 and y is a number of 0–20, in admixture with a co-builder which is a polymeric and/or copolymeric carboxylic acid or a salt of said acid.

7 Claims, No Drawings

RINSING COMPOSITION FREE FROM PHOSPHATE

This is a continuation of our copending application Ser. No. 07/080,961, filed Aug. 3, 1987, now abandoned.

This invention relates to rinsing compositions free from phosphate, especially for use in automatic dish washing machines, containing sodium silicate as a builder, a co-builder and active chlorine carrier.

Commercial rinsing compositions for the automatic washing of tableware or dishes and covers of the kind used in the household or industry normally contain builders, alkali carriers, active chlorine-carriers, surfactants, perfumes and fillers, if desired.

The ratio selected for mixing the individual components critically determines the particular uses the rinsing compositions are put to. The builders are normally selected from polyphosphates, preferably sodium triphosphate (STPP), the alkali carriers from water-soluble silicates, preferably sodium metasilicate, caustic soda or sodium carbonate, the active chlorine-carriers from chlorine bleach liquor or from products belonging to the chloroisocyanurate series, and the surfactants from slightly foaming, rather chlorine-stable block polymers with ethylene and propylene oxide groups or from modified fatty alcohol polyglycolethers.

All of the above products are relatively easily soluble in water and used at temperatures between 50° and 70° C.

In order to keep waste waters free from phosphates, it has already been attempted to replace the builder system in rinsing compositions by soluble or insoluble substitutes. Representatives of soluble substitutes are e.g. citrates or polycarboxylic acids, such as polyacrylic acid, but also nitrilotriacetic acid (NTA) or ethylene diaminetetracetic acid (EDTA) and its salts, and also various phosphonic acids and phosphonates. Typical representatives of insoluble substitutes are zeolite A and bentonite.

All of the above substitutes for STPP have however properties which do not permit using them in a commercial rinsing composition. More particularly, they partially have a minor cleaning power, more corrosiveness for the tableware or machines, shorter storage life or unfavorable properties, such as incompatibility with active chlorine carriers or coalescence.

Crystalline layer sodium silicates for water softening of the formula $NaMSi_xO_{2x+1} \cdot y\ H_2O$, in which M stands for sodium or hydrogen, x stands for 1.9–4 and y stands for 0–20, have already been disclosed in German Specification DE-A1- 34 13 571.

It has also been suggested that these products should be used, e.g. in admixture with pentasodium triphosphate, trisodium nitrilotrisulfonate and/or zeolite A, or also with phosphonates, polycarboxylates or further amorphous or crystalline silicates, as a builder in detergent and cleaning compositions, especially in rinsing compositions for tableware.

This suggestion has however not been reduced to practice. The crystalline layer sodium silicates were indeed found to be good water softeners, but not very suitable for use as a builder in a rinsing composition as they tend to deposit on, and tenaciously adhere to, the surface of glass or ceramic articles, and cannot be redissolved even by treating them with an acid.

The present invention now unexpectedly provides a rinsing composition for tableware, permitting the above adverse effects to be avoided, in which the builder is a crystalline layer sodium silicate of the general formula $NaMSi_xO_{2x+1} \cdot y\ H_2O$, where M stands for sodium or hydrogen, x stands for a number of 1.9–4 and y stands for a number of 0–20 , that is used in admixture with a co-builder being a polymeric and/or copolymeric carboxyclic acid or a salt, especially alkali metal salt, of said acid.

The rinsing composition of this invention should preferably contain:

30–50 wgt %, preferably 40 wgt %, crystalline layer sodium silicate
0.1–7.5 wgt % co-builder
up to 45 wgt % filler
10–25 wgt % alkali carrier
1–2 wgt % surfactant and
1–5 wgt % active chlorine carrier.

More particularly, 0.1–3 wgt % dry pulverulent co-builder is used and 0.3–7.5 wgt % liquid co-builder is used.

The useful co-builders should preferably be selected from polycarboxylates, e.g. oxymethylene carboxylates or maleic anhydride/acrylic acid-copolymers, or maleic anhydride methylene-vinylethers or their sodium salts. Further components of the rinsing composition of this invention comprise fillers, alkali carriers, surfactants and active chlorine-carriers and perfumes, if desired, which are selected from conventional standard agents.

A useful filler is e.g. sodium sulfate, which should conveniently be used in the form of anhydrous material; useful alkali carriers are sodium carbonate, caustic soda or water-soluble alkali metal silicates; useful surfactants are chlorine-stable block polymere of long chain aliphatic alcohols with ethylene oxide or propylene oxide groups, or modified fatty alcohol polyglycol ethers; and useful active chlorine-carriers are sodium dichloroisocyanurate or bleach liquor.

The phosphate-free rinsing compositions of this invention combine a very good cleaning power with extremely low corrosiveness for the tableware or rinsing machine and with high chlorine stability. The pulverulent compositions remain readily flowable even after storage over months in the laboratory in contact with air (cf. Table 2 hereinafter).

The present layer silicates also compare favorably with the insoluble phosphate substitute zeolite; they are substantially not or only little abrasive and thus permit glasses to be rinsed under mild conditions.

The following Examples are intended to demonstrate the advantageous properties of the compositions of this invention. Control tests were made on commercially available rinsing compositions based on phosphate, and on test compositions with zeolite A or layer silicate but free from the co-builder used in accordance with this invention. The surfactant used in all of the Examples was a block polymer of a linear $C_{12}$–$C_{15}$ alcohol with 4 propylene oxide and 7 ethylene oxide groups. The layer silicate was one which had the following formula $Na_2Si_2O_5$ and the following typical X-ray diffraction reflexes:

| d ($10^{-8}$ cm) | relative intensities |
|---|---|
| 4.92 (±0.10) | slight |
| 3.97 (±0.08) | very strong |
| 3.79 (±0.08) | medium/strong |

-continued

| d ($10^{-8}$ cm) | relative intensities |
|---|---|
| 3.31 (±0.07) | slight |
| 3.02 (±0.06) | slight/medium |
| 2.85 (±0.06) | slight |
| 2.65 (±0.05) | slight |
| 2.49 (±0.05) | slight |
| 2.43 (±0.05) | medium |

EXAMPLE 1 cleaning power

The following compositions were used:

(A)
30 wgt % granulated sodium triphosphate, partially hydrated
57 wgt % sodium metasilicate, anhydrous
10 wgt % sodium carbonate, anhydrous
2 wgt % sodium dichloroisocyanurate. 2 $H_2O$
1 wgt % surfactant (B)
50 wgt % zeolite A
40 wgt % sodium metasilicate, anhydrous
5.75 wgt % sodium sulfate, anhydrous
2.25 wgt % sodium dichloroisocyanurate. 2 $H_2O$
2 wgt % surfactant (C)
50 wgt % layer silicate
40 wgt % sodium silicate, anhydrous
5.75 wgt % sodium sulfate, anhydrous
2.25 wgt % sodium dichloroisocyanurate. 2 $H_2O$
2 wgt % surfactant In accordance with invention (D)
40 wgt % layer silicate
10 wgt % sodium carbonate, anhydrous
41 wgt % sodium sulfate anhydrous
5 wgt % maleic anhydride/methylenevinyl ester, liquid (35 % active substance)
2 wgt % sodium dichloroisocyanurate. 2 $H_2O$
2 wgt % surfactant (E)
40 wgt % layer silicate
25 wgt % sodium carbonate, anhydrous
28.85 wgt % sodium sulfate, anhydrous
1.9 wgt % maleic anhydride methylenevinyl ester, powder (92% active substance)
2.25 wgt % sodium dichloroisocyanurate. 2 $H_2O$
2 wgt % surfactant (F)
30 wgt % layer silicate
20 wgt % sodium carbonate, anhydrous
44.75 wgt % sodium sulfate, anhydrous
2 wgt % maleic anhydride/acrylic acid-copolymer, powder (92% active substance)
2.25 wgt % sodium dichloroisocyanurate. 2 $H_2O$
2 wgt % surfactant (G)
40 wgt % layer silicate
10 wgt % sodium carbonate, anhydrous
15 wgt % caustic soda
47 wgt % sodium sulfate, anhydrous
4 wgt % maleic anhydride methylenevinyl ester, liquid (35% active substance)
2 wgt % sodium dichloroisocyanurate. 2 $H_2O$
2 wgt % surfactant (H)
40 wgt % layer silicate
10 wgt % sodium carbonate, anhydrous
2 wgt % hydroxymethylene carboxylate, sodium salt
2 wgt % sodium dichloroisocyanurate. 2 $H_2O$
2 wgt % surfactant
44 wgt % sodium sulfate, anhydrous The above compositions were tested for their cleaning power in two different machines at 7° water-hardness (German degrees of hardness) as specified in DIN-draft specification 44 990 (DIN stands for German Industrial Standard). The machines used were a Bosch rinsing machine and a Miele rinsing machine. It was found that the particular machine used did not affect the results. The test results obtained are indicated in the following Table 1, which also indicates the influence of the pH selected for the rinsing liquor.

TABLE 1

| Rinsing composition | A | B | C | D | E | F | G | H |
|---|---|---|---|---|---|---|---|---|
| pH (20° C.) | 12.2 | 11.9 | 11.2 | 10.5 | 10.9 | 11.0 | 11.9 | 10.5 |
| Cleaning index DIN-Specification 44 990 | 4.2 | 4.0 | 4.4 | 3.9 | 4.2 | 3.9 | 4.4 | 4.4 |

A comparison of the cleaning indexes shows that the cleaning efficiency of the standard products is normally reached and that it is even possible for the pH-value to be lowered at a rate of 0.5 to 1.

EXAMPLE 2 chlorine stability

Specimens of the compositions A, B, F and G were stored in the laboratory over a period of about 4 months in contact with air. Next, the stored specimens and specimens of the fresh compositions were compared and their respective chlorine contents were determined. The decrease in percent of the chlorine content in the stored specimens is indicated in Table 2.

TABLE 2

| Rinsing composition | A | B | F | G |
|---|---|---|---|---|
| Loss of active chlorine in % | 39.0 | 41.5 | 6.3 | 8.1 |

As can be seen the rinsing compositions of this invention compare very favorably with standard products in respect of stability during storage.

EXAMPLE 3 corrosiveness for tableware

The materials to be rinsed comprised porcelain plates and cups, stainless steel covers from various manufactures, and glasses different in composition and design. Damage done to the articles was rated along an evaluation scale subdivided into 5 classes which was used for evaluating the tests by visual inspection after 125, 250, 500 and 1000 rinsing cycles, respectively. The evaluation scale permitted intermediary stages to be set at 0.5 intervals. (0=undamaged; 4.0=totally damaged).

The rinsing compositions A, B, C, D and E were tested for their corrosiveness. The mean damage evaluations found after 500 rinsing cycles are indicated in Table 3 below. The machine was an automatic domestic rinsing machine; after each rinsing cycle, the door of the machine was opened for 1 hour during which the articles dried completly. The water hardness varied between 2° and 7° (German degrees of hardness), the rinsing temperature was 62°-66° C., the quantity of water used per rinsing cycle was 28 liters, of which about 6 l for the cleaning operation with 30 g rinsing composition, and 3 ml rinsing composition for the rinsing operation.

TABLE 3

| Rinsing composition | A | B | C | D | E |
|---|---|---|---|---|---|
| Glass | 0.6 | 1.8 | 2 (incrustation*) | 0.6 | 0.7 |
| Porcelain | 0.5 | 0.3 | 2 (incrustation*) | 0 | 0.1 |
| Cover | 1.5 | 0.7 | 2 (incrustation*) | 0.4 | 0.8 |
| Sum | 2.5 | 2.8 | 6 | 1.0 | 1.6 |

*During this experiment, an incrustation which tenaciously adhered to the various articles and was difficult to remove, was found to form gradually.

The compositions found to form incrustations cannot be used commercially.

The test results obtained with compositions D and E indicate the corrosion inhibiting properties of the present compositions which use a layer silicate in combination with a co-builder.

We claim:

1. An improved rinsing composition for cleaning of hard surfaces and for preventing depositions thereon, said composition consisting essentially of:

as a builder, 30–50 weigth-% of a crystalline layer sodium silicate of the general formula $NaMSi_x O_{2x+1} \cdot y\ H_2O$, in which M stands for sodium or hydrogen, x stands for a number from 1.9 to 4 and y stands for a number from 0 to 20, as a co-builder, 0.1–7.5 weight-% of at least one substance selected from the group consisting of hydroxymethylene carboxylates, maleic acid anhydride, ethylene vinyl ether or maleic acid anhydride/acrylic acid copolymers or the sodium salts thereof, 0–45 weight-% of a filler, 10–25 weight-% of an alkali carrier, 1–2 weight-% of a surfactant, and 1–5 weight-% of an active chlorine carrier, said composition being free of phosphate.

2. The rinsing composition as claimed in claim 1, containing 0.1–3 wt % pulverulent co-builder.

3. The rinsing composition as claimed in claim 1, containing 0.3–7.5 wt % liquid co-builder.

4. The rinsing composition as claimed in claim 1, containing sodium dichloroisocyanurate or chlorine bleach liquor as the active chlorine-carrier.

5. The rinsing composition as claimed in claim 1, containing sodium sulfate as the filler.

6. The rinsing composition as claimed in claim 1, containing sodium carbonate, caustic soda or a water-soluble alkali metal silicate as the alkali carrier.

7. The rinsing composition as claimed in claim 1, containing, as the surfactant, as least one substance selected from the group consisting of chlorine-stable block polymers of long chain aliphatic alcohols with ethylene oxide and/or propylene oxide groups or modified fatty alcohol polyglycolethers.

* * * * *